US008863463B2

(12) United States Patent
Bøgeskov et al.

(10) Patent No.: US 8,863,463 B2
(45) Date of Patent: Oct. 21, 2014

(54) INSULATION BUILDING SYSTEM FOR A BUILDING STRUCTURE

(75) Inventors: Henrik Bøgeskov, København (DK); Peter Hesselholt, København (DK); Michael A. Thorsted, Brøndby (DK)

(73) Assignee: Rockwool International A/S, Hedehusene (DK)

( * ) Notice: Subject to any disclaimer, the term of this patent is extended or adjusted under 35 U.S.C. 154(b) by 160 days.

(21) Appl. No.: 12/999,331

(22) PCT Filed: Jun. 15, 2009

(86) PCT No.: PCT/EP2009/057331

§ 371 (c)(1),
(2), (4) Date: Jan. 31, 2011

(87) PCT Pub. No.: WO2009/153232

PCT Pub. Date: Dec. 23, 2009

(65) Prior Publication Data

US 2011/0113724 A1 May 19, 2011

(30) Foreign Application Priority Data

Jun. 17, 2008 (EP) ..... 08158386

(51) Int. Cl.

| | |
|---|---|
| ***E04C 2/38*** | (2006.01) |
| ***E04B 9/00*** | (2006.01) |
| ***E04B 2/00*** | (2006.01) |
| ***E04D 13/16*** | (2006.01) |
| ***E04C 2/296*** | (2006.01) |
| ***E04B 2/74*** | (2006.01) |
| ***E04B 1/26*** | (2006.01) |
| ***E04B 7/22*** | (2006.01) |

(52) U.S. Cl.

CPC ..... *E04B 1/26* (2013.01); *E04D 13/1625* (2013.01); *E04C 2/296* (2013.01); *E04B 2/7457* (2013.01); *E04B 7/225* (2013.01)

USPC ..... 52/586.1; 52/802.1; 52/475.1; 52/763

(58) Field of Classification Search

USPC ..... 52/586.1, 586.2, 802.11, 474–476, 762, 52/763, 309.11, 281

See application file for complete search history.

(56) References Cited

U.S. PATENT DOCUMENTS

| | | | | |
|---|---|---|---|---|
| 1,841,785 A * | 1/1932 | Bryant | ..... | 162/101 |
| 2,257,001 A * | 9/1941 | Davis | ..... | 52/601 |

(Continued)

FOREIGN PATENT DOCUMENTS

| | | |
|---|---|---|
| DE | 79 32 271 U1 | 4/1980 |
| DE | 20110293 U1 | 9/2002 |

(Continued)

OTHER PUBLICATIONS

DOW Dow Building Soultions, COmposite panel solutions with STYROFOAM, Form No. 802-00251BOE101007, p. 1-16.*

*Primary Examiner* — Elizabeth A Plummer

(74) *Attorney, Agent, or Firm* — Gifford, Krass, Sprinkle, Anderson & Citkowski, P.C.; Douglas L. Wathen

(57) ABSTRACT

The present invention concerns an insulation building system comprising an assembly having at least one frame profile, a plurality of joining profiles and insulation panels, wherein the insulation panels are retained between the joining profiles.

16 Claims, 5 Drawing Sheets

(56) References Cited

U.S. PATENT DOCUMENTS

| | | | | |
|---|---|---|---|---|
| 3,090,699 | A * | 5/1963 | Bulson | 106/215.1 |
| 4,062,721 | A * | 12/1977 | Guyer et al. | 162/101 |
| 4,169,688 | A | 10/1979 | Toshio | |
| 4,633,634 | A * | 1/1987 | Nemmer et al. | 52/474 |
| 5,047,120 | A * | 9/1991 | Izard et al. | 162/101 |
| 5,062,250 | A | 11/1991 | Buzzella | |
| 5,136,822 | A * | 8/1992 | Blum | 52/241 |
| 6,134,861 | A * | 10/2000 | Spude | 52/745.1 |
| 6,959,520 | B2 * | 11/2005 | Hartman | 52/838 |
| 7,073,301 | B1 * | 7/2006 | Price | 52/477 |
| 7,677,002 | B2 * | 3/2010 | Bennett et al. | 52/408 |
| 8,161,699 | B2 * | 4/2012 | LeBlang | 52/309.12 |
| 8,539,733 | B2 * | 9/2013 | Bogeskov et al. | 52/745.19 |
| 2003/0046892 | A1 | 3/2003 | Albany et al. | |
| 2006/0117689 | A1 * | 6/2006 | Onken et al. | 52/309.7 |
| 2006/0185305 | A1 * | 8/2006 | Schaffer | 52/586.1 |
| 2007/0227086 | A1 * | 10/2007 | Beavers et al. | 52/309.7 |
| 2012/0210657 | A9 * | 8/2012 | Sanders et al. | 52/145 |

FOREIGN PATENT DOCUMENTS

| | | | |
|---|---|---|---|
| EP | 1479825 | A1 | 11/2004 |
| EP | 0 896 106 | B2 | 9/2005 |
| WO | WO 8805096 | A * | 7/1988 |
| WO | 01/71119 | A1 | 9/2001 |
| WO | WO 2004110748 | A2 * | 12/2004 |
| WO | 2006086228 | A3 | 12/2006 |
| WO | 2007085260 | A1 | 8/2007 |

* cited by examiner 3
3
2
1
d
d
2
2
1
3
3
2
4
5

INSULATION BUILDING SYSTEM FOR A BUILDING STRUCTURE

CROSS-REFERENCE TO RELATED APPLICATIONS

This application is the U.S. national phase of PCT/EP2009/057331 filed Jun. 15, 2009, which claims priority of European Patent Application No. 08158386.6 filed Jun. 17, 2008.

The present invention relates to a building system for an external building structure, e.g. a wall or a roof, or an internal building structure, such as a partitioning wall or a ceiling structure.

In WO 00/26483 a method and a profile for connecting building blocks is described resulting in a wall in a building system. According to this method, two construction blocks are joined along an edge face of each block abutting each other by a profile having a web and two flanges on each side with a perpendicularly extending flap at the distal ends of these two flanges. These flaps are inserted into a groove in the construction blocks whereby the blocks are held together.

This method is advantageous since prefabricated construction blocks may be provided off site and transported to the building site together with other materials and may be assembled on the building site. However, if the rectangular frame is subjected to a twisting force, the gripping flanges may slide out of the slits in the insulation making the entire building system unstable.

By the present invention it is realised that a building structure may be provided utilising this connecting method for both internal as well as external building structures.

Accordingly, there is provided an insulating building system for an external building structure, such as a wall or a roof, or an internal building structure, such as a wall or a ceiling or floor structure, said system comprising an assembly having a first side and a second side opposite of said first side, wherein said building assembly comprises at least one frame profile, such as two frame profiles arranged opposite each other peripherally on the building structure, such as a top and/or a bottom profile; a plurality of joining profiles between and/or extending said at least one frame profile, said joining profiles having a first and second joining profile side surfaces which are abutted by the first and second contact sides, respectively, of adjacent insulating panels on each side of said joining profiles, wherein the opposite profile contact sides of the insulation panels are provided with a shape matching the first and second profile side surfaces, respectively, such that the insulation panels are retained between two profiles.

In one embodiment of the insulating building system, the total thickness of the insulation panels is larger than the height of the joining profiles. The total thickness of the insulation panels may be the thickness of a single insulation panel or, when double or multiple layers of insulation panels are provided, the sum of the thicknesses of the multiple provided insulation panels. Preferably, the height of the joining profiles is measured in a direction which is parallel to the direction in which the thickness of the insulation panels is measured and preferably the height of the joining profiles is measured as the distance from the outside of the first flange portion of the joining profile to the outside of the second flange portion of the joining profile in a direction parallel to the central body portion of the joining profile.

In a second embodiment of the insulating building system, a plurality of insulation panels is provided between two adjacent joining profiles, said insulation panels having a width corresponding to the axial distance between said two adjacent joining profiles. Further, in another embodiment, at least one insulation panel is provided between two adjacent joining profiles, said insulation panel having a width corresponding to the axial distance between said two adjacent joining profiles and a length corresponding to the length of said joining profiles.

The joining profiles may be made of sheet metal, such as galvanised steel, preferably with a thickness of 0.8-2 mm. The sheet metal may be bent or otherwise formed into the predetermined shape. Hereby the thermal conductivity of the joining profiles is kept low. The thermal conductivity may be further reduced by providing holes in the body portion of the profile, which is located between two insulation panels.

More preferably the sheet metal of the joining profiles and/or the peripheral frame profiles may have a thickness of 0.5-2 mm and yet more preferably 0.7-1.5 mm, more preferably 0.75 mm, in particular 0.6 mm, 0.8 mm, 1 mm or 1.2 mm.

In one embodiment of the invention, the profile abutment portions of the contact sides of the insulation panels are adapted to contact a central body portion of the generally I- or H-shaped joining profile.

According to an embodiment of the invention, the joining profiles are made of wood. Hereby, the thermal conductivity is reduced due to the low thermal conductivity of the material. In another embodiment of the invention, the joining profiles are made of plastic, preferably a reinforced plastic material.

In a preferred embodiment, the joining profiles are parallelly mounted so as to be spaced apart by a distance ranging from 400 mm to 1800 mm, preferably 500-1500 mm, more preferably 900-1200 mm. Hereby, the thermal conductivity of the building structure is significantly reduced. It is found possible to provide this extra wide distance between column profiles in a wall structure (which is usually approx. 600 mm) since the insulation provides for a self-supporting wall structure. If extra load bearing strength is need, it is of course realised that joining profiles may be parallelly mounted so as to be spaced apart by a distance of 400 to 800 mm. This could be advantageous for instance in relation to floor or roof constructions. By the invention it is also realised that the usual smaller distance between the joining profiles, e.g. between 400-700 mm, more preferably 450-600 mm, could be retained and instead thinner joining profiles are provided thereby also reducing the thermal conductivity. This becomes advantageous since the thin joining profiles are supported by the insulation panels.

Preferably, a first cover structure is provided on the first side of the assembly, and a second cover structure on said second side thereof.

In one embodiment, the first cover structure is a sheet cover, such as a plywood or gypsum sheet cover structure. In another embodiment, the second cover structure may be a climate shield cover, such as an insulated outer wall system. Hereby, a low energy solution having high thermal insulation properties is provided when using the system according to the invention for an external building structure.

In another embodiment, the system comprises at least one insulation panel for fitting between joining profiles, such as I- or H-profiles, in a framework of an insulating building system for an external building structure, such as a wall or a roof, or an internal building structure, such as a wall or a ceiling or floor structure, said panel comprising substantially parallel first and second main surfaces with substantially parallel, oppositely situated first and second joining profile contact sides and substantially parallel, oppositely situated third and fourth sides between said main surfaces, wherein said first and second joining profile contact sides are provided with a longitudinal slit substantially parallel to the first main surface in a predetermined distance therefrom so that said first and second joining profile contact sides are provided with a joining profile abutment portion and a joining profile covering portion.

In one embodiment of the insulation panel, the profile covering portion extends beyond the abutment portion of at least one of the side edges of the insulation panel.

The insulation panel may be used for a self-supporting system for an internal or external wall, floor, ceiling or roof in a building structure. In a vertically arranged building structure according to the invention, it is found that by providing the preformed insulation panels between the joining profiles, the joining profiles are prevented from buckling due to the compression load, since the insulation panels are not only retained at the first set of opposite sides abutting the adjacent joining profiles but are also retained by frame profiles at the other peripheral sides. By a system according to the invention, the form stability in the insulation panel, such as mineral fibrous insulation material, is utilised to prevent displacement in the building structure.

By a system according to the invention, it is realized that a fast installation time on the building site may be achieved. Moreover, it is a cost-effective and simple solution with a high degree of flexibility, as the system according to the invention may be used for different building applications.

The insulation panels are preferably made of a mineral fibre wool material with a density between 30-150 kg/m$^3$, preferably 50-125 kg/m$^3$ and most preferably 60-100 kg/m$^3$. Mineral fibre wool, such as stone wool fibre panels, is advantageous since a non-combustible building system is thereby provided. However, it is realised that other materials could be used, such as polystyrene foam or the like.

By the present invention, it is found that the insulation panels may have a total thickness ranging from 75 mm to 500 mm. Hereby also modern insulation requirements for domestic housings can be met by a building system according to the invention. In one embodiment, each insulation panel consists of one insulation slab. However, the invention may in one embodiment be used with an arrangement of double or multiple layers of insulation slabs, e.g. each insulation panel may comprise two or more insulation slabs provided in a stacked and/or layered configuration, whereby the total thickness of the insulation panel becomes roughly the sum of the thicknesses of the provided insulation slabs, which is suitable in particular for large thicknesses of insulation. Further, for large thicknesses of insulation, the profile may comprise fixing means, like claws or clamps, that may be bent out from the body portion of the profile to secure the different insulation layers.

In one embodiment of the invention, the insulation panels may have a dual density structure so that the density of the insulation panel between the profile covering portions of the two contact sides is higher than the density of the insulation panel between the profile abutment portions of the two contact sides. Further, an insulation panel may have a compression elasticity modulus of at least 500 kPa, preferably when measured parallel to the width of an insulation panel, where the width of an insulation panel typically is roughly equal to the distance between joining profiles.

The compression elasticity modulus, E, is preferably calculated according to the European Standard EN 826: 1996, which concerns thermal insulating products for building applications. According to the standard, section 8.3, the compression elasticity modulus, E, is calculated in kPa using the formula E=sigma*(d0/Xe) with sigma=(10^3)*(Fe/A0) where Fe is the force at the end of the conventional elastic zone (distinct straight portion of the force-displacement curve), in newtons; Xe is the displacement at Fe in millimeters; A0 is the initial cross-sectional area of the specimen, in square millimeters, and d0 is the initial thickness (as measured) of the specimen, in millimeters.

In one embodiment of the insulation panels, at least the profile abutment portions of the contact sides are provided with an adhesive layer for adhering to the profile. In one embodiment, the provided adhesive layer comprises gluing. Providing an adhesive layer may yield extra strength against shearing forces, may prevent bending of the insulation panels or the joining profiles, and may promote internal bracing and stability. Further, the insulation panels may be provided with slits in top and/or bottom side edges for receiving a flange of top and/or bottom frame profiles in the building structure for retention of the insulation panel therein.

Preferably, the side surfaces of the joining profiles and the corresponding contact surfaces on the insulation panels are shaped such that an insulation panel retaining is provided. In particular, the joining profiles are advantageously provided with retention profile members at both the first and second side of the partitioning assembly and preferably at least one of retention profile members of the joining profiles is adapted for subsequent mounting. In a particular embodiment, the joining profiles are generally I- or H-shaped. I- and H-shaped profiles are similar when rotated, although in practice there is distinguished between both due to the proportions of the flanges in relation to the body. By such suitable shape of the profile, the insulation panels are accommodated in the profile frame structure and prevented from being displaced, e.g. by a twist in the frame structure. By the invention it is realised that other suitable shapes may be used, such as C-shaped, H-shaped or Z-shaped profiles.

The invention is further explained in the following under reference to the accompanying drawings in which.

Figures 1, 2:
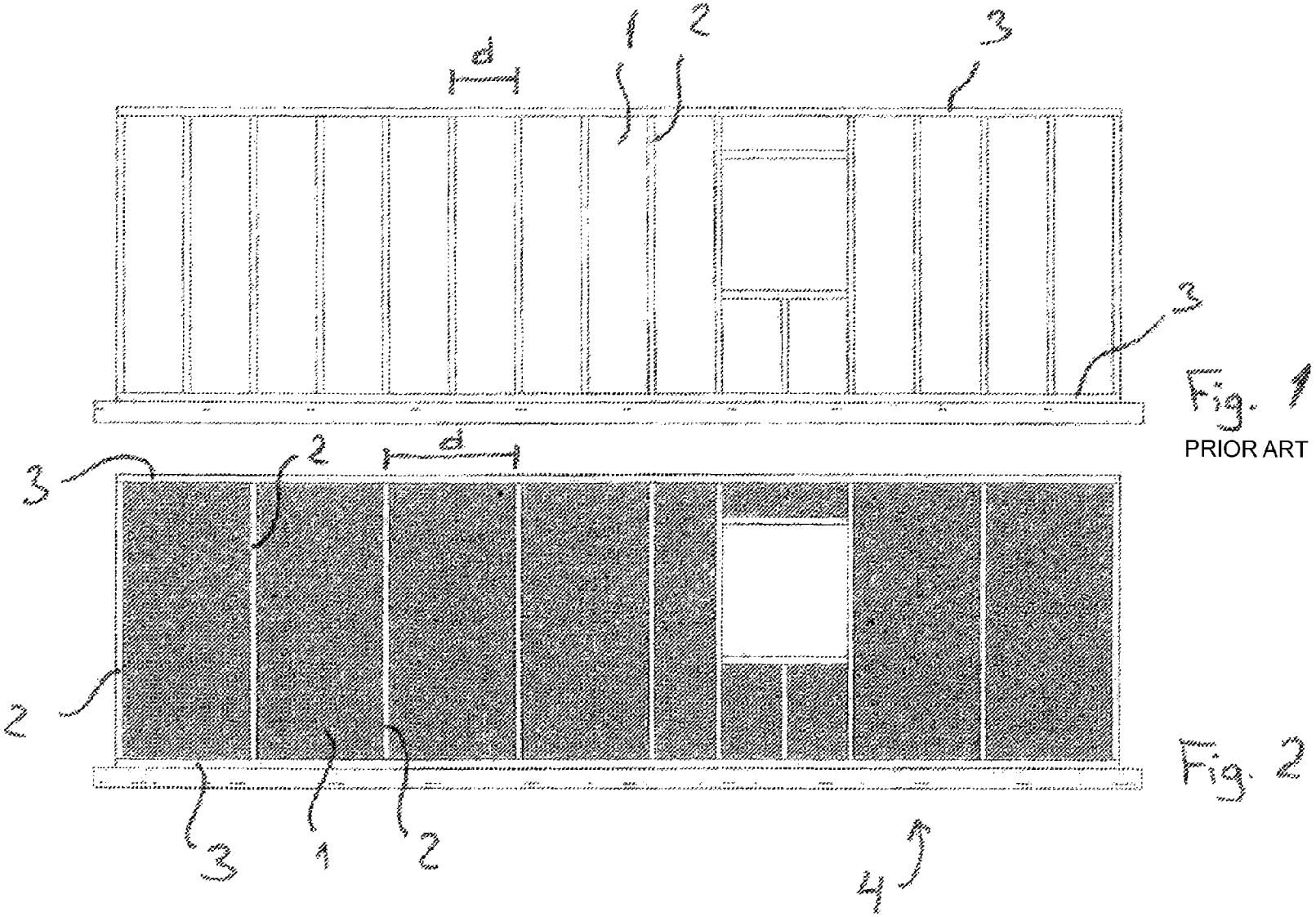
Fig. 1 PRIOR ART
FIG. 1 is a schematic view of a partition wall according to prior art.
FIG. 2 is a schematic view of a partition wall according to the invention.

With reference to FIGS. 1 and 2, the internal portioning structure 4 of an insulating building partitioning wall may be made by assembling a number of insulation panels 1 with joining profiles 2 and framing the assembled panels 1 in top and bottom frame profiles 3. The joining profiles 2 are provided with a distance d apart. In FIG. 1, this distance is approx. 600 mm whereas in FIG. 2, the distance d may be 900 to 1200 mm. The frame profiles 3 are preferably U- or C-shaped profiles with a cavity for receiving the insulation therein.

In one embodiment, the frame profiles comprise a U- or C-shaped bottom profile and a reverse U- or C-shaped top profile.

Figure 3:
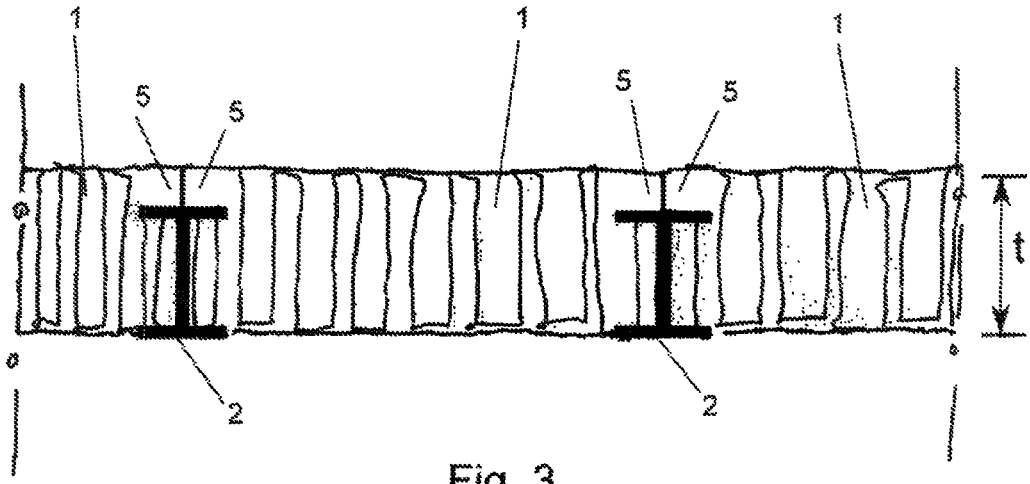
FIG. 3 is a schematic horizontal cross section view of joining profiles with mounted insulation panels.

With reference to FIG. 3, joining profiles 2 are mounted with insulation panels 1. The insulation panels 1 have flex zones 5 by which tight panel-panel junctions are achieved next to the joining profiles 2. A tight panel-panel junction may reduce thermal bridging and acoustic bridging. Reduction of thermal bridging may reduce heat dissipation and may protect the profiles in case of fires or the like. In addition, a tight junction may support a stiffening external cladding or bracing. In the embodiment shown, the total thickness t of the insulation panels is larger than the height of the joining profiles.

A flex zone/flexible zone is a portion of an insulation panel made less rigid during the manufacture, e.g. by pressing rollers into the zone and moving them along the edge. This has the advantage that this zone is compressible and may be compressed in order to provide a tight panel-panel junction or in order to fit between the rafters and beams of a building structure. Further, the need for different formats of panels is reduced by using a flexible zone comprising a flexible section along one side of the insulation panel.

A flex zone may be provided by softening the respective side by compressing or stretching the edge portion during manufacture and thereby reducing the fibre bonding in the flexible section. Hereby, the fibre bondings are partly broken making the fibrous insulation element flexible without reducing the density and without significantly influencing the thermal insulation properties.

Figure 4:
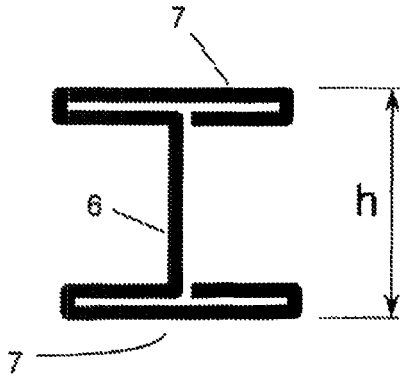
FIG. 4-5 are schematic cross section views of joining profiles.
Figure 5:
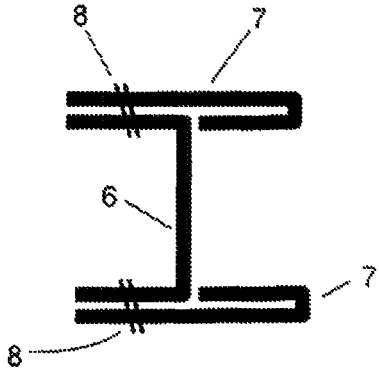
Figure 6:
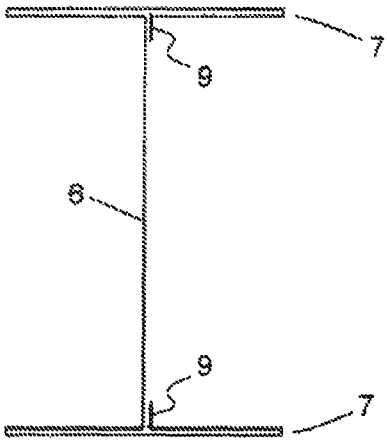
FIG. 6 is a schematic cross section view of another embodiment of a joining profile.

With reference to FIGS. 4-6, joining profiles with height h are shown in three embodiments. In one embodiment, see FIG. 4, the joining profile is bent in one piece from sheet metal. In another embodiment, see FIG. 5, the joining profiles are constructed from three elements of bended sheet metal, which are connected by welds 8. The joining profiles have a central body portion 6 and first and second flange portions 7. In a preferred embodiment, see FIG. 6, the joining profile comprises at least one stabilizing portion 9 extending from the flange portions 7, preferably substantially parallel to the central body portion 6. Preferably, the profile is bent in one piece from sheet metal and the bended flange portions 7 are bent once more so that they comprise stabilizing portions 9 which extend partly beyond the common corner of the flange and body portion of the profiles. This specific design results in an extremely high resistance against vertical loads and enables utilization of a small thickness in the central/main part of the body portion 6. The provided bended joining profiles are distinguished from known steel profiles that are normally extrusion moulded and which may comprise flange thicknesses that are almost double as thick as the corresponding body portion.

Figure 7:
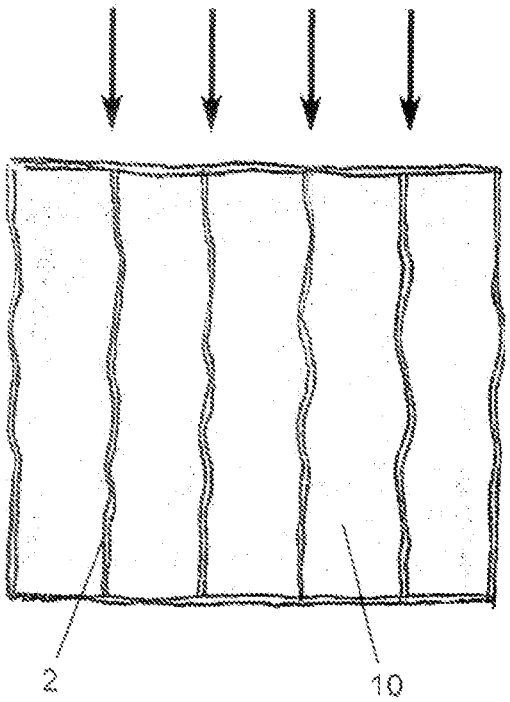
FIG. 7-8 are schematic vertical cross section views of insulating building systems.
Figure 8:
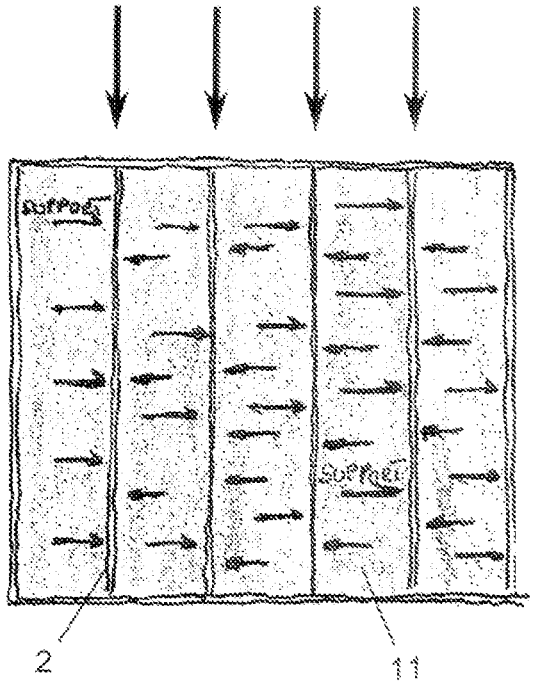

With reference to FIGS. 7 and 8, joining profiles 2 mounted with insulation panels, and subjected to a top-down force represented in the figures by vertical arrows, are shown in a vertical cross section view. A building system having low wool density insulation panels 10 is shown in FIG. 7. Since the wool density is low, the joining profiles are susceptible to bending. In FIG. 8 is shown a building system having high wool density insulation panels 11. Because of the high wool density, stronger lateral forces support the joining profiles 2 such that the joining profiles 2 are less susceptible to bending.

Figure 9:
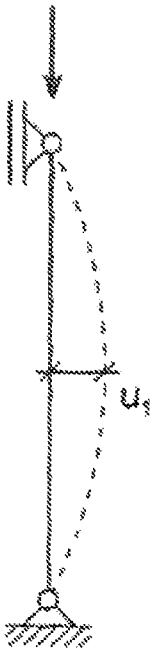
FIG. 9-10 are illustrations of bending with and without lateral support.
Figure 10:
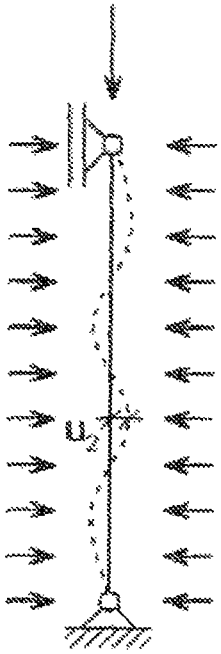

With reference to FIGS. 9 and 10, bending of a joining profile caused by a top-down force is shown in conceptual illustrations. The bending amplitude u2 of the joining profile in FIG. 10 is smaller than the bending amplitude u1 of the joining profile in FIG. 9 because the joining profile in FIG. 10 is stabilized by lateral forces. In addition, the buckling length is smaller when a joining profile is stabilized by lateral forces.

Figure 11:
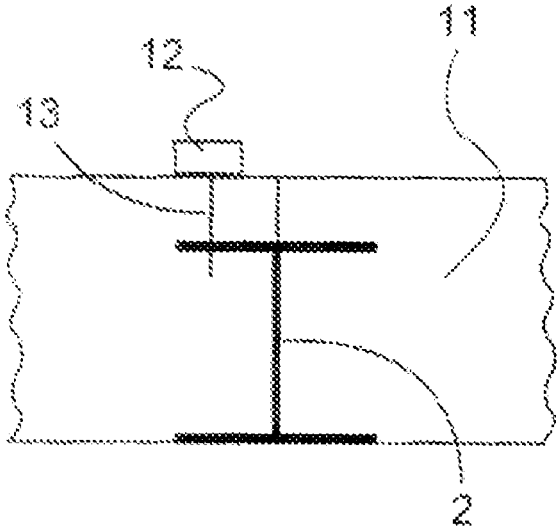
FIG. 11-12 are schematic horizontal cross section views of insulating building systems supporting outer building elements.
Figure 12:
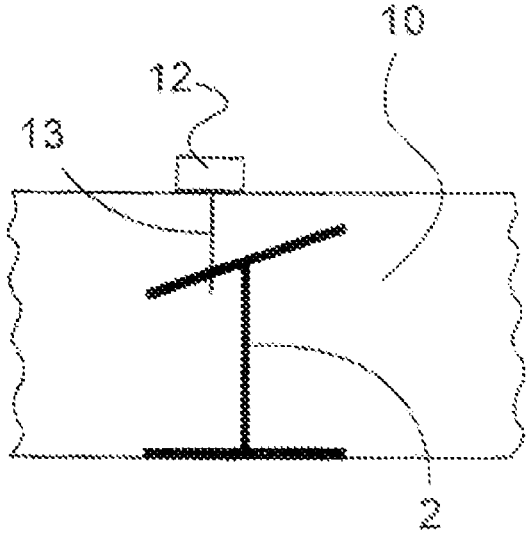

With reference to FIGS. 11 and 12, there are shown horizontal cross section views of an insulating building system with high wool density insulation panels 11 in FIG. 11, and a corresponding building system with low wool density insulation panels 10 in FIG. 12. A joining profile 2 in a high wool density building system may support an additional building element 12 for instance by nail 13 or screwing engagement without bending, whereas a joining profile in a low wool density building system is prone to bending when support of an additional building element is pursued because low wool density insulation panels 10 provide less support for joining profiles compared to the support provided by high wool density insulation panels 11.

Figure 13:
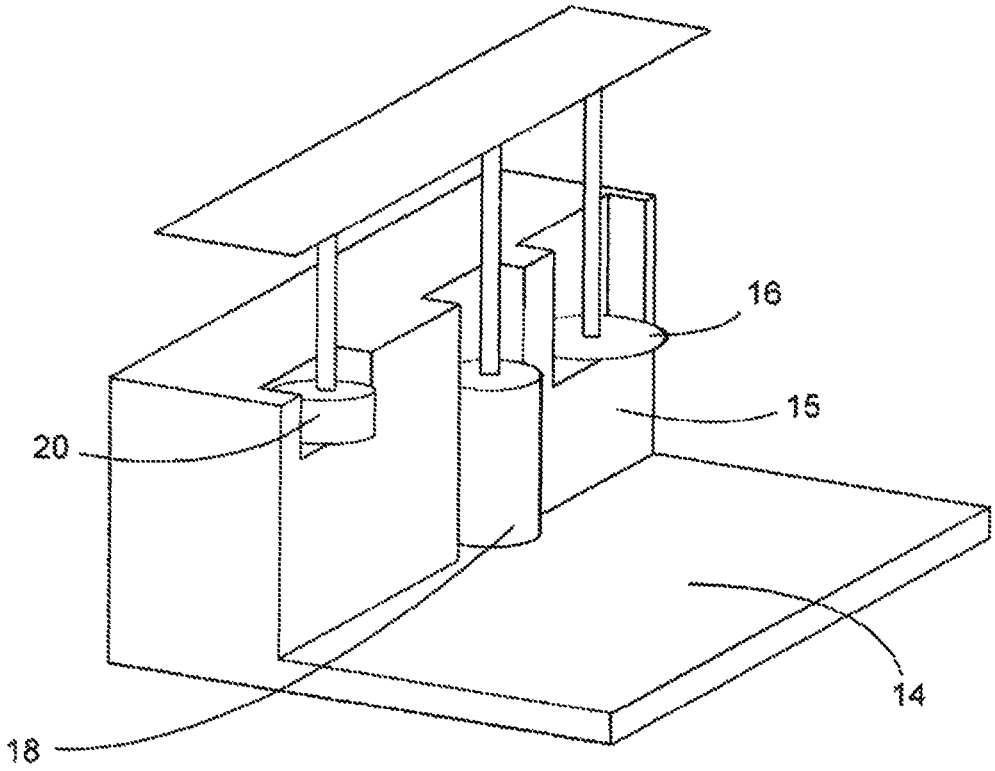
FIG. 13 is a schematic perspective view of an apparatus for producing an insulation panel.
Figure 14:
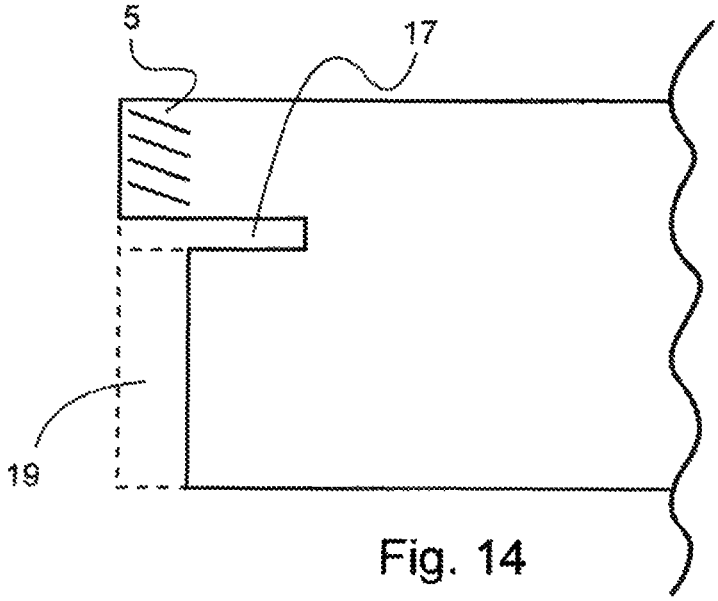
FIG. 14 is a schematic cross sectional view of the edge detail of an insulation panel.

With reference to FIGS. 13 and 14, there is shown a schematic view of an embodiment of an apparatus for producing insulation panels and an edge detail of an insulation panel produced by such an apparatus. The apparatus, see FIG. 13, has a planar work surface 14 and a guiding flange 15 for receiving an insulation panel, which is slideable on the surface 14 along the guiding flange 15. The apparatus is provided with a first cutting means 16, such as a rotating cutting blade or a circular saw, for providing a slit 17 in the side of the insulation panel, which slit may fit with a portion of a flange of a joining profile. Further, there is provided a second cutting means 18, such as a grinding tool for removing material 19 of from the insulation panel. For instance, insulation material may be removed from the abutment portion of the contact side of the insulation panel. Furthermore, there is provided a manipulation means 20, such as a compression roller or a knife drum, for compressing or extending a profile covering portion to provide a flex zone 5 in said portion. In one embodiment, the apparatus is adapted for modification of standard sized insulation panels in order to fabricate modified insulation panels having specific dimensions so that the modified insulation panels may fit into specific building structures. This may prove advantageous at the construction site whereto standard sized insulation panels are easily delivered.

Above, some embodiments currently considered advantageous are described. For instance, the invention is described with reference to a building system for a building structure, such as a vertical building system, for instance a wall or the like. However, it is realised that variants to these embodiments may be provided without departing from the inventive principles illustrated above. Further, by the invention it is realised that other advantageous embodiments may be provided without departing from the scope of the invention as set forth in the accompanying claims. For instance, any of the structures shown in the embodiments above may be used with different orientations, vertically, horizontally or inclined, and may also be used for either internal or external partitioning building structures in a building.

The invention claimed is:

1. An insulating building system for a building structure, said system comprising:

an assembly having a first side and a second side opposite of said first side, wherein said assembly comprises a plurality of self supporting insulation panels each made of a mineral fiber wool material having a density between 50-125 kg/m$^3$ and a compression elasticity modulus of at least 500 kPa, when measured parallel to the width of said insulation panel, each insulation panel having joining profile contact sides;

at least one frame profile;

a plurality of spaced apart joining profiles extending from at least one of said at least one frame profile, said plurality of joining profiles each having a first and second side surface which are abutted by a first and a second joining profile contact side, respectively, of insulating panels which are disposed on each side of said plurality of joining profiles, wherein said first and second joining profile contact sides of said insulation panels are provided with a shape matching the respective first and second side surfaces of said plurality of joining profiles, such that the insulation panels are retained between two of said plurality of joining profiles; and wherein the insulation panels provide lateral support to the joining profiles such that the bending amplitude and the buckling length of the joining profile are reduced;

whereby the assembly provides a self-supporting and load bearing building structure.

2. A system according to claim 1, wherein the total thickness of each of the insulation panels is larger than the height of the plurality of joining profiles.

3. A system according to claim 1, wherein the plurality of joining profiles are generally I- or H-shaped and wherein the profile abutment portions of the first and second contact sides of the insulation panels are configured to contact a central body portion of the generally I- or H-shaped profile.

4. A system according to claim 1, wherein the at least one frame profile is U- or C-shaped.

5. A system according to claim 1, wherein the plurality of joining profiles are made of sheet metal having a thickness of 0.5-2 mm.

6. A system according to claim 5, wherein the sheet metal has a thickness of 0.7-1.5 mm.

7. A system according to claim 1, wherein the plurality of joining profiles are made of plastic or a reinforced plastic material.

8. A system according to claim 1, wherein the plurality of joining profiles are mounted in a parallel relationship with each other so that respective pairs thereof are spaced apart by a distance of 400 mm to 1800 mm.

9. A system according to claim 1, wherein the plurality of joining profiles are mounted in a parallel relationship with each other so that respective pairs thereof are spaced apart by a distance of 400-800 mm.

10. A system according to claim 1, wherein at least two insulation panels are provided between two adjacent ones of said plurality of joining profiles, said at least two insulation panels each having a width corresponding to the axial distance between said two adjacent ones of said plurality of joining profiles.

11. A system according to claim 1, wherein at least one insulation panel is provided between two adjacent ones of said plurality of joining profiles, said at least one insulation panel having a width corresponding to the axial distance between said two adjacent ones of said plurality of joining profiles and a length corresponding to the length of said two adjacent ones of said plurality of joining profiles.

12. A system according to claim 1 wherein at least one panel of said insulation panels is fitted between adjacent ones of said plurality of joining profiles in a framework of an insulating building system for a building structure, said at least one panel comprising substantially parallel first and second main surfaces with substantially parallel, oppositely situated first and second joining profile contact sides and substantially parallel, oppositely situated third and fourth sides between said main surfaces, wherein said first and second joining profile contact sides are provided with a longitudinal slit substantially parallel to the first main surface in a predetermined distance therefrom so that said first and second joining profile contact sides are provided with a joining profile abutment portion and a joining profile covering portion.

13. A system according to claim 1, wherein at least one insulation panel is provided with a dual density structure so that the density of the insulation panel between the profile covering portions of the first and second joining profile contact sides is higher than the density of the insulation panel between the profile abutment portions of the first and second joining profile contact sides.

14. A system according to claim 1, wherein at least one insulation panel has a total thickness between 75 to 500 mm.

15. A system according to claim 1, wherein at least the profile abutment portions of the first and second joining profile contact sides of said insulating panels are provided with an adhesive layer for adhering to the profile.

16. A system according to claim 1, comprising at least one insulation panel, wherein there are also provided slits in top or bottom side edges of said plurality of joining profiles for receiving a flange of top or bottom frame profiles in the building structure for retention of at least one of the insulation panels therein.

* * * * *